United States Patent [19]

Jost et al.

[11] Patent Number: 5,064,562

[45] Date of Patent: Nov. 12, 1991

[54] STABLE PUMPABLE ZEOLITE/SILICONE SUSPENSIONS

[75] Inventors: Philippe Jost, Paris; Marc Malassis, Franconville, both of France

[73] Assignee: Rhone-Poulenc Chimie, Courbevoie, France

[21] Appl. No.: 594,558

[22] Filed: Oct. 9, 1990

[30] Foreign Application Priority Data

Oct. 9, 1989 [FR] France ..... 89 13137

[51] Int. Cl.[5] ..... C11D 3/08; C11D 3/12; C11D 7/14

[52] U.S. Cl. ..... 252/174.15; 252/75; 252/173; 252/174.25; 252/156; 252/89.1; 252/159

[58] Field of Search ..... 252/89.1, 174.15, 174.25, 252/156, 546, 159, 49.5, 75, 455

[56] References Cited

U.S. PATENT DOCUMENTS

| | | | |
|---|---|---|---|
| 3,915,878 | 10/1975 | Yurko | 252/89 |
| 4,402,867 | 9/1983 | Rodewald | 252/455 |
| 4,454,056 | 6/1984 | Kittelmann | 252/174.15 |
| 4,639,321 | 1/1987 | Barrat | 252/546 |
| 4,673,516 | 6/1987 | Berry | 252/49.5 |
| 4,692,264 | 9/1987 | Gresser | 252/174.25 |
| 4,702,855 | 10/1987 | Goossens et al. | 252/75 |

FOREIGN PATENT DOCUMENTS

| | | |
|---|---|---|
| 0012346 | 6/1980 | European Pat. Off. . |
| 0154291 | 9/1985 | European Pat. Off. . |
| 0233689 | 8/1987 | European Pat. Off. . |
| 2523950 | 9/1983 | France . |

OTHER PUBLICATIONS

Patent Abstracts of Japan, vol. 11, No. 106 (C-414) (2553), 3 Apr. 1987; & JP-A-61,256,915 (Showakoki K.K.) 14.11.1986.

*Primary Examiner*—Paul Lieberman
*Assistant Examiner*—Kevin D. McCarthy
*Attorney, Agent, or Firm*—Burns, Doane, Swecker & Mathis

[57] ABSTRACT

Stable suspensions of zeolite particulates, in water, well adapted for detergency applications, have a pumpable low viscosity and include an effective viscosity reducing amount of a silicone resin and, advantageously, a suspension stabilizer, e.g., an alkaline earth metal cation or a biogum polysaccharide.

24 Claims, No Drawings

STABLE PUMPABLE ZEOLITE/SILICONE SUSPENSIONS

CROSS-REFERENCE TO COMPANION APPLICATIONS

Copending applications Ser. No. 594,561 [Attorney Docket No. 022701-118] and Serial No. 593,961 [Attorney Docket No. 022701-119], both filed concurrently herewith and both assigned to the assignee hereof.

BACKGROUND OF THE INVENTION

1. Field of the Invention

The present invention relates to novel zeolite/silicone suspensions and to the use of such novel suspensions for detergency applications.

2. Description of the Prior Art

The use of zeolites in detergent compositions is well known to this art. Thus, the zeolites have at least partially replaced the phosphates in detergents. Indeed, the phosphates are believed to be responsible for the eutrophication of water supplies and thus of presenting ecological and environmental difficulties.

However, the known zeolite suspensions present many disadvantages in industrial handling because of their very unusual rheological behavior.

Indeed, these suspensions tend to expand. Their viscosity is very high; they are, therefore, difficult to pump, which makes their use, for example their incorporation into detergent slurries, which may be sprayable, difficult, if not impossible. Moreover, these suspensions also have a tendency to sediment or to gel, which makes them difficult to transport or store.

SUMMARY OF THE INVENTION

Accordingly, a major object of the present invention is the provision of novel aqueous zeolite suspensions having low viscosity, which novel suspensions are particularly pumpable and which otherwise conspicuously ameliorate those disadvantages and drawbacks to date characterizing the state of this art.

Another object of the present invention is the provision of novel zeolite suspensions that are stable over time and in storage.

Briefly, the present invention features novel suspensions of the zeolites, in water, such novel zeolite suspensions also comprising a silicone resin.

DETAILED DESCRIPTION OF THE PREFERRED EMBODIMENTS OF THE INVENTION

More particularly according to the present invention, in a preferred embodiment thereof, the subject zeolite suspensions also contain at least one stabilizer.

The effect of the incorporation of the silicone resins is to lower the viscosity of the zeolite suspensions considerably. It also enables suspensions to be produced that are easily handled and which have a higher solids content, for example of at least 55%. Finally, it too has been determined that the resins do not adversely affect the exchange capacity of the zeolites.

Suitable zeolites for the formulation of the suspensions of the present invention comprise the naturally occurring or synthetic crystalline, amorphous and mixed crystalline/amorphous zeolites.

Of course, those capable of reacting sufficiently rapidly with calcium and/or magnesium ions such as to soften washing waters are the preferred.

Typically, finely divided zeolites are used which have an average primary particle diameter ranging from 0.1 to 10 μm and advantageously from 0.5 to 5 μm, as well as a theoretical cation exchange capacity in excess of 100 mg of $CaCO_3$/g of anhydrous product and preferably of more than 200 mg.

The zeolites of the A, X or Y type, and in particular 4A and 13X, are the preferred.

The products described in French Patent Applications Nos. 2,225,568, 2,269,575 and 2,283,220, hereby expressly incorporated by reference, are exemplary zeolites that can be used to formulate the novel suspensions of the present invention.

The zeolites prepared by the processes described in French Patent Applications Nos. 2,376,074, 2,384,716, 2,392,932 and 2,528,722, assigned to the assignee hereof and hereby also expressly incorporated by reference, are particularly preferred. The '722 application in particular describes zeolites having a rate constant, related to the surface area of the zeolites per liter of solution, of more than 0.15 $s^{-1}.l.m^{-2}$, preferably more than 0.25 and which advantageously ranges from 0.4 to 4 $s^{-1}l.m^{-2}$. These zeolites have particularly desirable properties in detergency applications.

The aforenoted '932 application, in particular, describes zeolites prepared by a process entailing injecting an aqueous solution of sodium silicate into the axis of a venturi, while an aqueous solution of sodium aluminate is injected coaxially into the same venturi, with recycling of the resulting mixture.

In particular, zeolites of the formula:

$$x\ Na_2O,\ y\ Al_2O_3,\ zSiO_2,\ wH_2O$$

are produced in which if $y=1$, $x=1$, $z=1.8$ to 2 and $w=0$ to 5 and which have a particle size distribution corresponding to the following numerical distribution: 95% < 10 μm, 99% < 15 μm, 50% ranging from 2 to 6 μm in average diameter.

The suspensions can have a variable zeolite concentration, depending on the intended application thereof. For detergency applications, this concentration typically ranges from 40% to 51%.

The pH of the suspensions also depends on the intended application thereof. Also for detergency applications, this pH, expressed at 1% by weight of dry zeolite, is about 11.

According to the primary characteristic of the present invention, a silicone resin dispersing agent is incorporated into the suspensions described above.

These silicone resins are branched organopolysiloxane polymers which are well known to this art and are available commercially. They comprise, per molecule, at least two different structural units selected from among those of the formulae $R_3SiO_{0.5}$ (unit M), $R_2SiO$ (unit D), $RSiO_{1.5}$ (unit T) and $SiO_2$ (unit Q).

The radicals R are identical or different and are each a straight or branched chain alkyl radical, or a vinyl, phenyl or 3,3,3-trifluoropropyl radical.

Preferably, the alkyl radicals have from 1 to 6 carbon atoms, inclusive.

More particularly representative alkyl radicals R are the methyl, ethyl, isopropyl, tert.-butyl and n-hexyl radicals.

These resins are preferably hydroxylated and in this event have a hydroxyl group content by weight ranging from 0.1 to 10%.

Exemplary such resins are the MQ resins, the MDQ resins, the TD resins and the MDT resins.

It is particularly advantageous to incorporate resins having a molecular weight of less than 25,000.

In particular, the products marketed by the assignee hereof under the trademarks RHODORSIL 865 A or 878 A are exemplary resins of this type.

The resins can be used in the solid state, or in the form of aqueous emulsions, or of emulsions or solutions in an organic solvent.

The amount of resin incorporated advantageously ranges from 0.01 to 2% by weight of total solids content, more particularly ranging from 0.05 to 0.3% relative to the suspension.

As indicated above, the effect of incorporation of the silicone resins is to render the zeolite suspensions pumpable and handleable by reason of their low viscosity.

However, the final product suspensions are also stable, namely, they do not settle or settle to only a slight extent In this case, these suspensions can be transported or stored without difficulty.

In a preferred embodiment of the invention, the suspensions contain a stabilizer in addition to the silicone resin.

Thus, an alkaline earth metal cation is a representative stabilizer according to the present invention. Compare FR-A-2,568,790 in this respect, assigned to the assignee hereof and hereby expressly incorporated by reference.

The cation preferably used is magnesium.

The cation may, however, be supplied in the form of a halide, in particular of a chloride. More particularly, magnesium chloride, for example magnesium chloride hexahydrate, is used.

The amount of cation employed typically ranges from 0.002 to 0.5% by weight relative to the weight of the suspension.

Naturally occurring polysaccharides of animal origin, such as chitosan and chitin; of vegetable origin, such as carragenenans, alginates, gum arabic, guar gum, carob gum, tara gum, cassia gum and konjak mannan gum, and finally those of bacterial origin or biogums, are exemplary of other types of stabilizers which may be used according to this invention.

The biogums are polysaccharides having high molecular weights, generally of more than one million, produced by fermentation of a carbohydrate under the action of a microorganism.

The following are particularly representative biogums which can be included in the suspensions of the present invention: xanthan gum, i.e., that produced by fermentation using bacteria or fungi belonging to the genus Xanthomonas, such as *Xanthomonas begoniae, Xanthomonas campestris, Xanthomonas carotae, Xanthomonas hederae, Xanthomonas incanae, Xanthomonas malvacearum, Xanthomonas papavericola, Xanthomonas phaseoli, Xanthomonas pisi, Xanthomonas vasculorum, Xanthomonas vesicatoria, Xanthomonas vitians* and *Xanthomonas pelargonii.*

The xanthan gums are currently available commercially.

One example of a product of this type is that marketed under the trademark RHODOPOL by the assignee hereof.

Other gums which are exemplary are gellan gum produced from *Pseudomonas elodea,* and Rhamsan and Welan gums produced from Alcaligenes.

Synthetic or chemically modified gums containing cellulose can also be used.

Thus, the macromolecular polyholosides can be used, in particular cellulose and starch, or derivatives thereof. Exemplary thereof are carboxymethylcellulose, methylcellulose, ethylcellulose, hydroxymethylcellulose, cyanoethyl starch and carboxymethyl starch.

The stabilizers described above (polysaccharides, biogums and modified gums) are used in solid form, as a powder or as an aqueous solution.

They are advantageously incorporated in an amount ranging from 0.001 to 2% and more particularly from 0.01 to 0.5% by weight relative to the weight of the suspension.

Carboxylic acids and their salts, and in particular acetic, formic, oxalic, malic, citric and tartaric acids, are representative of other types of stabilizers.

Alkali metal salts, such as $NaHCO_3$, NaCl, $Na_2CO_3$, $Na_2SO_4$ and sodium pyrophosphate or sodium tripolyphosphate, are also representative.

For these two types of stabilizers, amounts of 0.05 to 10% are used, expressed as percentage by weight relative to the weight of the suspension.

Water-soluble acrylic acid polymers crosslinked with a sucrose polyallyl ether, for example in a proportion of about 1% and having an average of about 5.8 allyl groups per sucrose molecule, the polymers having a molecular weight of more than 1,000,000, may also be used. The polymers of this type comprise the Carbopol series, for example Carbopol 934, 940 and 941.

For this latter type of stabilizer, the amounts used, expressed as percentage by weight relative to the suspension, range from 0.001 to 2%.

It will of course be appreciated that the stabilizers indicated above can be used alone or in combination.

The preparation of the zeolite suspensions according to the invention is carried out in a simple manner by introducing the additives described above into the suspension and mixing.

If necessary, the pH of the suspensions can be adjusted to the desired value in known manner by adding any suitable neutralizing agent.

The suspensions containing the zeolites and stabilized by the systems described above are useful in numerous applications.

They can be used in the form of suspensions essentially based on zeolites and the stabilizing additives described above. In this case, they can be used in the preparation of detergent compositions. They can also be used in any field other than detergency in which zeolites are currently employed, for example in papermaking.

The present invention also features novel detergent compositions, in particular liquid detergents, which in addition to the suspensions based on zeolites and the stabilizers, also contain all of the other additives typically included in detergency applications, such as bleaching agents, foam-control agents, anti-soil agents, perfumes, colorants and enzymes.

In order to further illustrate the present invention and the advantages thereof, the following specific example is given, it being understood that same is intended only as illustrative and in nowise limitative.

EXAMPLE

In this Example, the suspensions were formulated as described above and the immediately following definitions and processing parameters were employed:

The solids content of the suspension is reported in % by weight of anhydrous zeolite determined by measuring the weight loss on heating at 850° C. for one hour.

The pH indicated is reported for an aqueous dispersion containing 1% of dry zeolite and it was measured using a high alkalinity pH electrode.

With regard to the rheology, the rheometer used was a RHEOMAT 30 fitted with a centered B measurement system. The measurement entailed observing a velocity gradient cycle (ascending and descending). The range of velocity gradient investigated ranged from 0.0215 to 157.9 $s^{-1}$, which corresponded to speeds of rotation of the moving body of 0.0476 to 350 revolutions per minute. The viscosities reported below correspond to the measurements obtained during the descent of the velocity gradient.

The sedimentation was determined by introducing the zeolite suspension into 50 or 100 cc graduated cylinders. The volumes of supernatant and settled material were measured every five days. The cylinders were maintained at ambient temperature (20° C.) or placed in a thermostat-controlled chamber.

A resin in which R was methyl was used. This resin was used in the solid state. It is marketed by the assignee hereof under the trademark RHODORSIL 865 A in the form of an emulsion.

The results are reported in the Table below.

Experiment 1 was carried out using 0 17% by weight of silicone resin relative to the suspension and 1% by weight of oxalic acid. Experiment 2 was carried out by way of comparison using the same suspension adjusted to the same pH with oxalic acid alone, in the same amount, but without the silicone resin; the suspension of Experiment 2 was stable but was viscous. Experiment 3 was carried out by way of comparison using a suspension containing 49.3% of zeolite, without resin and without oxalic acid; the suspension of Experiment 3 was not stable.

TABLE

| Experiment | 1 | 2 (Comparative) | 3 (Comparative) |
|---|---|---|---|
| Anhydrous zeolite % by weight | | | |
| suspension | 49.3 | 49.3 | 49.7 |
| pH | 10.87 | 10.86 | 11.57 |
| Viscosity at $5s^{-1}$ | 40.3 | 71.3 | 59.2 |
| Sedimentation | | | |
| Supernatant % by volume | | | |
| 5 days | 3 | | 3.5 |
| 10 days | 8 | | 6 |
| 15 days | | | |
| Settled material % by volume | | | |
| 5 days | <<1 | | 60 |
| 10 days | <<1 | | 90 |
| 15 days | | | |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A stable suspension of zeolite particulates, in water, said zeolite suspension having a pumpable low viscosity and comprising an effective viscosity reducing amount of a silicone resin.

2. The stable zeolite suspension as defined by claim 1, having a solids content of at least 55% by weight.

3. The stable zeolite suspension as defined by claim 1, said zeolite particulates having an average primary particle diameter ranging from 0.1 to 10 μm.

4. The stable zeolite suspension as defined by claim 1, said zeolite particulates having an average primary particle diameter ranging from 0.5 to 5 μm.

5. The stable zeolite suspension as defined by claim 1, comprising zeolite A, X or Y particulates.

6. The stable zeolite suspension as defined by claim 5, comprising zeolite 4A or 13X particulates.

7. The stable zeolite suspension as defined by claim 1, having a zeolite concentration ranging from 40 to 51%.

8. The stable zeolite suspension as defined by claim 1, having a pH, expressed at 1% by weight of dry zeolite, of about 11.

9. The stable zeolite suspension as defined by claim 1, said silicone resin comprising an organopolysiloxane polymer containing, per molecule, at least two structural units of the formulae $R_3SiO_{0.5}$ (unit M), $R_2SiO$ (unit D), $RSiO_{1.5}$ (unit T) and $SiO_2$ (unit Q), wherein the radicals R, which may be identical or different, are each a straight or branched chain alkyl radical, or a vinyl, phenyl or 3,3,3-trifluoropropyl radical.

10. The stable zeolite suspension as defined by claim 9, said silicone resin comprising a hydroxylated such organopolysiloxane polymer.

11. The stable zeolite suspension as defined by claim 9, said silicone resin comprising an MQ, MDQ, TD or MDT organopolysiloxane polymer.

12. The stable zeolite suspension as defined by claim 9, said silicone resin having a molecular weight of less than 25,000.

13. The stable zeolite suspension as defined by claim 1, comprising from 0.05 to 0.3% by weight of said silicone resin.

14. The stable zeolite suspension as defined by claim 9, wherein R is a methyl radical.

15. The stable zeolite suspension as defined by claim 1, further comprising a suspension-stabilizing amount of at least one stabilizer in addition to the silicone resin.

16. The stable zeolite suspension as defined by claim 15, said at least one stabilizer comprising an alkaline earth metal cation.

17. The stable zeolite suspension as defined by claim 16, said alkaline earth metal cation comprising magnesium.

18. The stable zeolite suspension as defined by claim 15, said at least one stabilizer comprising a polysaccharide.

19. The stable zeolite suspension as defined by claim 18, said polysaccharide comprising a biogum.

20. The stable zeolite suspension as defined by claim 19, said biogum comprising a xanthan gum.

21. The stable zeolite suspension as defined by claim 15, said at least one stabilizer comprising cellulose, starch or derivative thereof.

22. The stable zeolite suspension as defined by claim 15, said at least one stabilizer comprising a carboxylic acid or salt thereof, or an alkali metal salt.

23. The stable zeolite suspension as defined by claim 15, said at least one stabilizer comprising a crosslinked acrylic acid polymer.

24. A detergent composition comprising the stable zeolite suspension as defined by claim 1

* * * * *